United States Patent [19]

Sorensen

[11] Patent Number: 4,846,350

[45] Date of Patent: Jul. 11, 1989

[54] HOLLOW, STACKABLE MOLDED PRODUCT WITH RIGIDIFYING SKIRT-SHAPED FLANGE

[75] Inventor: Jens O. Sorensen, Rancho Santa Fe, Calif.

[73] Assignee: Primtec, Rancho Santa Fe, Calif.

[21] Appl. No.: 51,056

[22] Filed: May 14, 1987

[51] Int. Cl.[4] ..... B65D 21/02; B65D 1/42

[52] U.S. Cl. ..... 206/520; 220/72

[58] Field of Search ..... 220/72; 206/519, 520

[56] References Cited

U.S. PATENT DOCUMENTS

| | | | |
|---|---|---|---|
| 3,223,305 | 12/1965 | Edwards | 206/519 |
| 4,181,226 | 1/1980 | Weinert | 206/519 |

FOREIGN PATENT DOCUMENTS

| | | | |
|---|---|---|---|
| 2902857 | 7/1980 | Fed. Rep. of Germany | 206/519 |
| 1292217 | 10/1972 | United Kingdom | 206/520 |
| 1379371 | 1/1975 | United Kingdom | 206/519 |
| 2061699 | 5/1981 | United Kingdom | 206/519 |

*Primary Examiner*—George E. Lowrance

*Attorney, Agent, or Firm*—Edward W. Callan

[57] ABSTRACT

A hollow, stackable, injection-molded plastic product having a given stacking height includes a perimetric ledge extending generally in a lateral direction; an upper perimetric side wall extending generally upward from the ledge for a height exceeding the stacking height of the product; a lower perimetric side wall spaced from the upper perimetric side wall by the ledge and extending from the ledge generally downward for a height exceeding the stacking height of the product wherein at the ledge the cross-sectional area defined by the first perimetric side wall is greater than the cross-sectional area defined by the second perimetric side wall; and a rigidifying skirt-shaped perimetric flange extending generally in an upward or downward direction from the perimetric ledge. Thus, the rigidity of the side walls of the product is further enhanced by the flange without having to increase the stacking height of the product beyond what the stacking height would be were it not for the perimetric flange. One such skirt-shaped flange is outside of and spaced from the lower perimetric side wall and extends from the ledge in a generally downward direction. Such flange also provides the feature of interposing an effective thermal insulating barrier between the fingers of a person holding the product and a substance within the product. The product preferably has a series of ledges joining adjacent side walls and a plurality of skirt-shaped flanges respectively extending from the plurality of ledges to provide a series of such insulating barriers along the exterior of the product. This feature is particularly important for protecting the fingers of users of thin-walled plastic cups containing hot beverages. The rigidity of the product may be still further enhanced by a second skirt-shaped flange inside of and spaced from the upper perimetric side wall and generally extending from the ledge in an upward direction.

16 Claims, 1 Drawing Sheet

HOLLOW, STACKABLE MOLDED PRODUCT WITH RIGIDIFYING SKIRT-SHAPED FLANGE

BACKGROUND OF THE INVENTION

The present invention generally pertains to hollow, stackable, molded plastic products and is particularly directed to enhancing the rigidity of such products.

Hollow, stackable, molded plastic products, such as beverage cups, typically have tapered perimetric side walls. Typically, the permetric side walls are circumferential. The side walls are tapered so that the products may be stacked by inserting one product into another. Each product has a given stacking height defined by the height that a product when inserted into a like product extends beyond the height of the like product. The stacking height for a given product is determined by physical features of the product that cause the inserted product to contact the like receiving product to limit the dimension of product insertion. The "stacking height" for a given product is the difference in height between the top of one said given product and the top of another said given product stacked within the one said given product. Typically, the inserted end of the inserted product contacts an interior ridge or some other interior protrusion near the base of the like receiving product to limit the dimension of product insertion; and the stacking height is such in relation to the tapering of the side walls and the height of the product as to prevent the side walls of the inserted product from so closely contacting the side walls of the like receiving product as to tend to bind the products together when they are stacked.

As injection molding techniques have evolved, hollow, stackable, injection-molded plastic products have been made with thinner side walls in order to conserve plastic and thereby decrease the material cost of the product. As the side walls have become thinner it has become desirable to enhance the rigidity of the product. Rigidity has been enhanced by providing a series of steps in the perimetric tapered side walls. Typically, each step is defined by a combination of a ledge; a first perimetric side wall generally extending from the ledge in a first direction; and a second perimetric side wall spaced from the first perimetric side wall by the ledge and extending from the ledge in a direction generally opposite from the first direction, wherein at the ledge the cross-sectional area of the first perimetric side wall is greater than the cross-sectional area of the second perimetric side wall.

In one such product configured as a generally cylindrical container having slightly tapered circumferential side walls, a base and an open top, the rigidity of the top portion of the product closer to the widest end of the product than the stacking height of the product is enhanced by the combination of a circumferential ledge joining the upper and lower circumferential side walls near the top of the product and a skirt-shaped circumferential flange extending from the ledge. The skirt-shaped flange is outside of and spaced from the lower circumferential side wall, and extends from the ledge in a direction away from the top of the product.

SUMMARY OF THE INVENTION

The present invention provides a hollow, stackable, injection-molded plastic product, in which the rigidity of the side walls is enhanced by providing one or more perimetric flanges in a region of the product removed from the widest end of the product by more than the stacking height of the product. The product of the present invention has a given stacking height and includes a perimetric ledge extending generally in a lateral direction; an upper perimetric side wall extending generally upward from the ledge for a height exceeding the stacking height of the product; a lower perimetric side wall spaced from the first perimetric side wall by the ledge and extending generally downward from the ledge for a height exceeding the stacking height of the product; and a rigidifying skirt-shaped perimetric flange extending generally in an upward or downward direction from the perimetric ledge. Thus the rigidity of the side walls of the product is further enhanced in a region removed from the widest end of the product by more than the stacking height of the product, and thereby inserted into a receiving like product when stacked, without having to increase the stacking height of the product beyond what the stacking height would be were it not for the perimetric flange.

In one aspect of the present invention, the skirt-shaped flange is outside of and spaced from the lower perimetric side wall and extends from the ledge in a generally downward direction. Such flange also provides the feature of interposing an effective thermal insulating barrier between the fingers of a person holding the product and a substance within the product. The product preferably has a series of ledges joining adjacent side walls and a plurality of skirt-shaped flanges respectively extending from the plurality of ledges to provide a series of such insulating barriers along the exterior of the product. This feature is particularly important for protecting the fingers of users of thin-walled plastic cups containing hot beverages.

The rigidity of the product may be still further enhanced by a second skirt-shaped flange inside of and spaced from the upper perimetric side wall and generally extending from the ledge in a generally upward direction.

Additional features of the present invention are described with reference to the description of the preferred embodiments.

DESCRIPTION OF THE PREFERRED EMBODIMENTS

Figure 1:
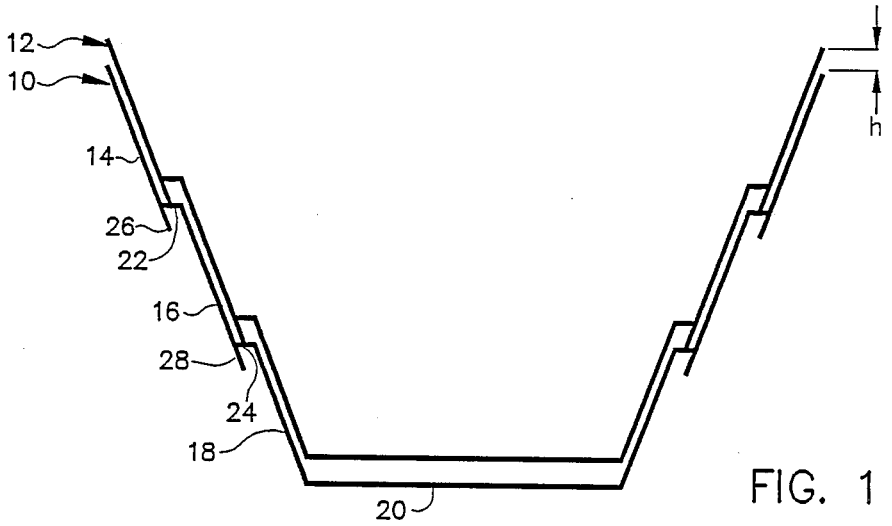
FIG. 1 illustrates two stacked products according to one preferred embodiment of the present invention.

Referring to FIG. 1, a first hollow, stackable, injection-molded plastic product 10 is inserted within a like product 12. The product 10 is shaped as a beverage cup having a series of first, second and third perimetric side walls 14, 16, 18 and a base 20. The perimetric side walls 14, 16, 18 are circumferential and tapered. The product includes a plurality of steps for enhancing the rigidity of the product.

A first perimetric (circumferential) ledge 22 joins the second perimetric side wall 16 with the first perimetric side wall 14; and a second circumferential ledge 24 joins the third perimetric side wall 18 with the second perimetric side wall 16 in order to define the rigidifying steps of the product.

The first perimetric side wall 14 generally extends from the first ledge 22 in a first direction.

The second perimetric side wall 16 is spaced from the first perimetric side wall 14 by the first ledge 22 and extends from the first ledge 22 in a direction generally opposite from the first direction. At the first ledge 22, the cross-sectional area defined by the first perimetric side wall 14 is greater than the cross-sectional area defined by the second perimetric side wall 16.

The third perimetric side wall 18 is spaced from the second perimetric side wall 16 by the second ledge 24 and extends from the second ledge 24 in a direction generally opposite from the first direction. At the second ledge 24, the cross-sectional area defined by the second perimetric side wall 16 is greater than the cross-sectional area defined by the third perimetric side wall 18.

A first skirt-shaped perimetric flange 26 extends from the first perimetric ledge 22, and a second skirt-shaped perimetric flange 28 extends from the second perimetric ledge 24. The skirt-shaped flanges 26,28 further enhance the rigidity of the product 10.

The first skirt-shaped flange 26 is outside of and spaced from the second perimetric side wall 16 and extends from the first ledge 22 in a direction generally opposite from the first direction.

The second skirt-shaped flange 28 is outside of and spaced from the third perimetric side wall 18 and extends from the second ledge 24 in a direction generally opposite from the first direction.

The stacking height "h" of the product is defined by the height of the skirt-shaped perimetric flange 26 plus the thickness of the ledge 22; and the height of the first perimetric side wall 14 is greater than the stacking height of the product.

Figure 2:
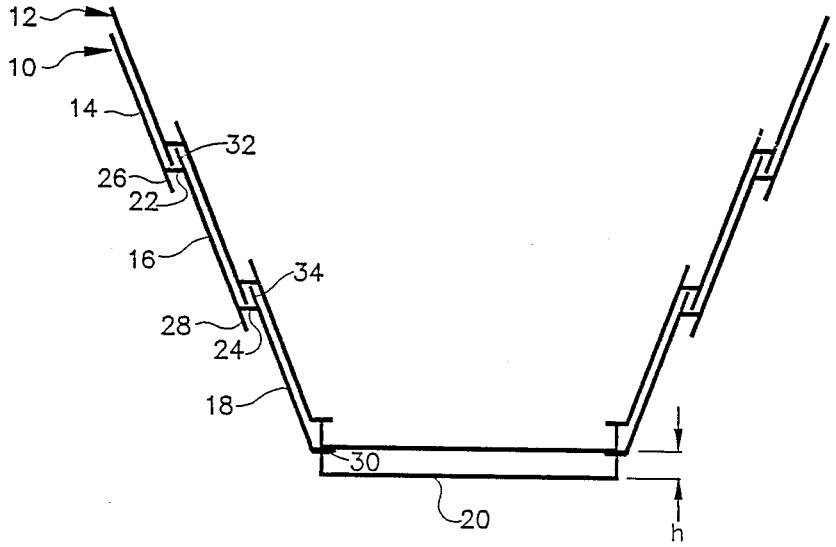
FIG. 2 illustrates two stacked products according to an alternative preferred embodiment of the present invention.

An alternative preferred embodiment of the product of the present invention is shown in FIG. 2. In the embodiment of FIG. 2, the product 10 further includes a third skirt-shaped flange 32 and a fourth skirt-shaped flange 34. The third skirt-shaped flange 32 is inside of and spaced from the first perimetric side wall 14 and generally extends from the first ledge 22 in the first direction. The fourth skirt-shaped flange 34 is inside of and spaced from the second perimetric side wall 16 and generally extends from the second ledge 24 in the first direction. The third and fourth skirt-shaped perimetric flanges further enhance the rigidity of the product 10.

In the embodiment of FIG. 2, the stacking height "h" is determined by the separation of an interior ridge 30 from the base 20. The interior ridge 30 contacts the base 20 of the inserted like product 12 to limit such insertion and thereby determine the stacking height "h" of the products 10, 12.

In other respects, the products 10 and 12 of FIG. 2 are the same as the products shown in FIG. 1, and the same reference numerals are used to refer to the same components.

The respective heights of the flanges 26, 28, 32 and 32 are not greater than the stacking height "h" of the products 10, 12.

The product of the present invention has other uses in addition to use as a beverage container. For example, it may be used as a food container or as a flower pot. Also it may be made as a tubular product not having a base closing either end of the product. When it is desired to use such a tubular product as a container, a base can be secured to one end of the product.

The skirt-shaped perimetric flanges need not be cylindrical in order to be removed from the mold, when the plastic is flexible.

Various other embodiments will be obvious to those skilled in the art. For example, in contrast to the embodiments shown in the Drawing, the flanges may be misaligned with the side walls, and the ledges may be other than coplaner.

I claim:

1. A hollow stackable plastic product having a given stacking height as defined by the difference in height between the top of one said product and the top of another said product stacked within the one said product, comprising a perimetric ledge extending generally in a lateral direction;

an upper perimetric side wall extending generally upward from the ledge for a height exceeding the stacking height of the product;

a lower perimetric side wall spaced from the upper perimetric sidewall by the ledge and extending generally downward from the ledge for a height exceeding the stacking height of the product; and a rigidifying skirt-shaped flange extending generally in an upward or downward direction from the perimetric ledge;

wherein the flange, the upper side wall and the lower side wall are so disposed in relation to the ledge as to enable both the upper side wall and the lower side wall to extend from the ledge for a height exceeding the stacking height of the product.

2. A product according to claim 1, wherein the skirt-shaped flange is outside of and spaced from the lower perimetric side wall and extends from the ledge in a generally downward direction.

3. A product according to claim 2, further comprising a second rigidifying skirt-shaped flange inside of and spaced from the upper perimetric side wall and generally extending from the ledge in an upward direction.

4. A product according to claim 1, further comprising a second rigidifying skirt-shaped flange inside of and spaced from the upper perimetric side wall and generally extending from the ledge in an upward direction.

5. A product according to claim 1, further comprising a second perimetric ledge extending from the upper sidewall generally in a lateral direction, wherein the upper perimetric side wall extends generally upward from the second ledge for a height exceeding the stacking height of the product; and a second skirt shaped perimetric flange extending generally in an upward or downward direction from the second perimetric ledge.

6. A product according to claim 1, wherein the height of the perimetric flange plus the thickness of the ledge define the stacking height of the product.

7. A product according to claim 1, wherein the skirt-shaped flange extends for a height from the perimetric ledge of less than the given stacking height of the product.

8. A hollow stackable plastic product with a top perimetric edge and a bottom perimetric edge, and having a given stacking height as defined by the difference in height between the top of one said product and the top of another said product stacked within the one said product, the product comprising a perimetric ledge positioned a greater height than the stacking height from both the top perimetric edge and the bottom perimetric edge of the product;

an upper perimetric side wall extending generally in an upward direction from the ledge;

a lower perimetric side wall extending generally in a downward direction from the ledge; and a rigidifying skirt shaped flange extending generally in an upward or downward direction from the ledge;

wherein the flange, the upper side wall and the lower side wall are so disposed in relation to the ledge as to enable the ledge to be positioned a greater height than the stacking height from both the top perimetric edge and the bottom perimetric edge of the product.

9. A product according to claim 8, wherein the flange is outside of and spaced from the lower perimetric side wall and extends in a generally downward direction.

10. A product according to claim 8, wherein the flange is inside of and spaced from the upper perimetric side wall and extends in a generally upward direction.

11. A product according to claim 10, further comprising a second rigidifying skirt-shaped flange, which is outside of and spaced from the lower perimetric side wall and extends in a generally downward direction from the ledge.

12. A product according to claim 8, wherein at the ledge ledge cross-sectional area defined by the upper perimetric side wall is greater than the cross-sectional area defined by the lower perimetric side wall.

13. A product according to claim 12, wherein the flange is outside of and spaced from the lower perimetric side wall and extends in a generally downward direction.

14. A product according to claim 12, wherein the flange is inside of and spaced from the upper perimetric side wall and extends in a generally upward direction.

15. A product according to claim 14, further comprising a second rigidifying skirt-shaped flange, which is outside of and spaced from the lower perimetric side wall and extends in a generally downward direction from the ledge.

16. A product according to claim 8, further comprising a second perimetric ledge positioned a greater height than the stacking height from both the top perimetric edge and the bottom perimetric edge of the product; and a second rigidifying skirt-shaped flange extending generally in an upward or downward direction from the second ledge.

* * * * *